US010161640B2

(12) United States Patent
Sprayberry et al.

(10) Patent No.: US 10,161,640 B2
(45) Date of Patent: Dec. 25, 2018

(54) MULTI-ZONE VARIABLE REFRIGERANT FLOW HEATING/COOLING UNIT

(71) Applicant: MJC, Inc., Acworth, GA (US)

(72) Inventors: Kelly Gene Sprayberry, Marietta, GA (US); Joel John Williams, Norcross, GA (US); Charles Thomas Couch, Rome, GA (US); Edward H. Metzger, Acworth, GA (US)

(73) Assignee: MJC, Inc., Acworth, GA (US)

( * ) Notice: Subject to any disclaimer, the term of this patent is extended or adjusted under 35 U.S.C. 154(b) by 0 days.

(21) Appl. No.: 15/417,388

(22) Filed: Jan. 27, 2017

(65) Prior Publication Data

US 2017/0138619 A1 May 18, 2017

Related U.S. Application Data

(63) Continuation of application No. 14/752,346, filed on Jun. 26, 2015.

(Continued)

(51) Int. Cl.

| | |
|---|---|
| ***F24F 3/00*** | (2006.01) |
| ***F24F 3/048*** | (2006.01) |
| ***F24F 3/044*** | (2006.01) |
| ***F24D 5/04*** | (2006.01) |
| ***F24F 11/83*** | (2018.01) |

(Continued)

(52) U.S. Cl.

CPC ..... *F24F 3/048* (2013.01); *F24D 5/04* (2013.01); *F24F 3/0442* (2013.01); *F24F 11/83* (2018.01); *F24F 12/006* (2013.01); *F24F 13/20* (2013.01); *F24F 2003/0446* (2013.01); *F24F 2003/0448* (2013.01); *F24F 2203/1032* (2013.01)

(58) Field of Classification Search

CPC ..... F24F 3/048; F24F 11/008; F24F 12/006; F24F 13/20; F24D 5/04

USPC ..... 165/208

See application file for complete search history.

(56) References Cited

U.S. PATENT DOCUMENTS

| | | | |
|---|---|---|---|
| 2,603,882 | A | 7/1952 | Mayer |
| 3,478,817 | A | 11/1969 | Shaw |

(Continued)

FOREIGN PATENT DOCUMENTS

| | | |
|---|---|---|
| DE | 102013100330 A1 | 7/2014 |
| WO | WO2014108552 | 7/2014 |

OTHER PUBLICATIONS

Duggin, Cory, P.E., "VRF: Overcoming Challenges to Achieve High Efficiency", https://www.csemag.com/single-article/vrf-overcoming-challenges-to-achieve-high-efficiency/, retrieved from the internet on Jun. 13, 2018.*

(Continued)

*Primary Examiner* — Ljiljana Ciric

(74) *Attorney, Agent, or Firm* — Lee & Hayes, P.C.

(57) ABSTRACT

An air conditioning that includes a housing. The housing encloses a mode control unit that switches a zone coil associated with a zone from a cooling mode to a heating mode by switching from a cooling medium to a heating medium flowing through the zone coil. The zone coil receives the heating or cooling medium and conditions incoming air from a supply fan to be exhausted in a zone associated with the zone coil. A variable refrigerant flow cooling/heating unit provides a cooling medium or a heating medium at varying rates to control a temperature of a zone.

6 Claims, 9 Drawing Sheets

Related U.S. Application Data

(60) Provisional application No. 62/457,109, filed on May 5, 2015.

(51) Int. Cl.
*F24F 12/00* (2006.01)
*F24F 13/20* (2006.01)

(56) References Cited

U.S. PATENT DOCUMENTS 3,601,937 A 8/1971 Campbell
3,623,543 A 11/1971 Ostrander
3,670,764 A 6/1972 Tindal
3,899,022 A 8/1975 Persson
3,927,827 A 12/1975 Strindehag
3,941,310 A 3/1976 Travaglio et al.
4,086,781 A * 5/1978 Brody ..... F24F 3/0442 165/250
4,124,021 A 11/1978 Molitor
4,238,071 A 12/1980 Post
4,244,517 A 1/1981 Stanke et al.
4,315,415 A 2/1982 Wilson
4,386,733 A 6/1983 Bradshaw
4,407,185 A 10/1983 Haines et al.
4,527,734 A 7/1985 Swain et al.
4,531,573 A 7/1985 Clark et al.
4,540,118 A 9/1985 Lortie et al.
4,549,601 A 10/1985 Wellman et al.
4,553,696 A 11/1985 Ichikawa et al.
4,630,670 A 12/1986 Wellman et al.
4,633,937 A 1/1987 Zilbermann
4,635,445 A 1/1987 Otsuka et al.
4,711,394 A 12/1987 Samuel
4,730,461 A 3/1988 Meckler
4,732,318 A 3/1988 Osheroff
4,739,624 A 4/1988 Meckler
4,748,822 A 6/1988 Erbs et al.
4,811,897 A 3/1989 Kobayashi et al.
5,133,193 A 7/1992 Wruck et al.
5,407,002 A 4/1995 Voll
5,579,654 A 12/1996 Longsworth et al.
5,597,354 A 1/1997 Janu et al.
5,863,246 A 1/1999 Bujak, Jr.
5,931,227 A 8/1999 Graves
6,089,464 A 7/2000 Morgan
6,202,429 B1 3/2001 Kinkel et al.
6,205,738 B1 3/2001 Chen
6,233,824 B1 5/2001 Dobbs et al.
6,301,776 B1 10/2001 Myung et al.
6,422,527 B1 7/2002 Lees
7,243,004 B2 7/2007 Shah et al.
7,441,589 B2 10/2008 Garrabrant et al.
8,347,644 B2 1/2013 Liu et al.
8,397,522 B2 3/2013 Springer et al.
8,564,924 B1 10/2013 Waddell et al.
8,631,661 B2 1/2014 Teige et al.
9,410,752 B2 * 8/2016 Wallace ..... F28F 27/00
9,551,504 B2 * 1/2017 Arensmeier ..... F24F 11/02
9,625,184 B2 * 4/2017 Hu ..... F25B 13/00
9,677,777 B2 6/2017 Karamanos et al.
2002/0164944 A1 * 11/2002 Haglid ..... B25B 27/0035 454/228
2003/0064676 A1 4/2003 Federspiel
2003/0085023 A1 5/2003 Viso
2003/0146289 A1 8/2003 Sekhar et al.
2003/0150593 A1 8/2003 Sekhar et al.
2003/0171092 A1 9/2003 Karamanos et al.
2004/0182941 A1 9/2004 Alles
2004/0253918 A1 12/2004 Ezell et al.
2005/0006488 A1 1/2005 Stanimirovic
2005/0022963 A1 2/2005 Garrabrant et al.
2005/0039470 A1 2/2005 Laing et al.
2005/0155365 A1 7/2005 Shah et al.
2005/0155367 A1 7/2005 Shah
2005/0156050 A1 7/2005 Shah et al.
2006/0151161 A1 * 7/2006 Richter ..... B60H 1/00064 165/203
2006/0249589 A1 11/2006 Karamanos
2006/0287774 A1 12/2006 Yoon et al.
2007/0256432 A1 * 11/2007 Zugibe ..... F25B 43/02 62/115
2007/0262162 A1 11/2007 Karamanos
2008/0003940 A1 * 1/2008 Haglid ..... F24F 3/14 454/228
2008/0135648 A1 6/2008 Smiltneek et al.
2008/0156887 A1 7/2008 Stanimirovic
2008/0164006 A1 7/2008 Karamanos
2008/0202155 A1 8/2008 Taras et al.
2010/0012291 A1 1/2010 Sporie
2010/0076605 A1 3/2010 Harrod et al.
2010/0229585 A1 * 9/2010 Bradford ..... F24F 1/0003 62/291
2010/0229587 A1 9/2010 Liu et al.
2011/0016893 A1 1/2011 Dawes
2011/0155354 A1 6/2011 Karamanos et al.
2012/0041608 A1 * 2/2012 Zugibe ..... G06F 17/5068 700/285
2012/0064818 A1 * 3/2012 Kurelowech ..... F24F 12/006 454/251
2012/0071082 A1 3/2012 Karamanos
2012/0125029 A1 * 5/2012 Moreau ..... F24D 3/18 62/235.1
2012/0186279 A1 7/2012 Cur et al.
2012/0210736 A1 8/2012 Rockenfeller et al.
2013/0091874 A1 4/2013 Sillato et al.
2013/0178987 A1 7/2013 Meirav et al.
2013/0180266 A1 * 7/2013 Bois ..... F25B 30/02 62/56
2013/0333412 A1 12/2013 Platt
2014/0000861 A1 * 1/2014 Barrett ..... B60H 1/00871 165/208
2014/0013788 A1 1/2014 Kopko et al.
2014/0208776 A1 * 7/2014 Hu ..... F25B 13/00 62/56
2014/0260404 A1 9/2014 Verma et al.
2014/0324404 A1 * 10/2014 de la Torre-Bueno ..... G06F 17/5009 703/6
2014/0326428 A1 11/2014 Meirav et al.
2014/0332197 A1 11/2014 Kuang et al.
2014/0354126 A1 * 12/2014 DeLorean ..... A47B 51/00 312/236
2015/0019022 A1 * 1/2015 Karamanos ..... G05D 7/0647 700/276
2015/0135755 A1 * 5/2015 Rich ..... F28D 19/041 62/272
2015/0330690 A1 * 11/2015 Goel ..... F25B 7/00 62/175
2016/0061494 A1 * 3/2016 Vasvari ..... F25B 13/00 62/324.1
2016/0146522 A1 * 5/2016 Hung ..... F25B 13/00 62/115
2016/0161163 A1 * 6/2016 Hung ..... F25B 13/00 62/205
2016/0308473 A1 * 10/2016 Alexander ..... F24F 3/044
2016/0327287 A1 11/2016 Sprayberry et al.
2016/0370029 A1 * 12/2016 Kurelowech ..... F24F 12/006
2017/0003044 A1 * 1/2017 Shah ..... F24F 11/006
2017/0082308 A1 * 3/2017 Gokhale ..... F24F 11/006
2017/0122580 A1 5/2017 Karamanos et al.
2017/0131011 A1 * 5/2017 Zugibe ..... F25B 49/02

OTHER PUBLICATIONS

"DNA Mechanical: VRF Supply and Install", http://dnamech.ca/variable-refrigerant-flow, retrieved from the internet on Jun. 13, 2018.*

Office Action for U.S. Appl. No. 14/752,346, dated Aug. 25, 2017, Sprayberry, "Multi-Zone Variable Refrigerant Flow Heating/Cooling Unit", 14 pages.

(56) References Cited

OTHER PUBLICATIONS

PCT Search Report and Written Opinion dated Aug. 5, 2016 for PCT Application No. PCT/US16/030871, 10 pages.
"Variable Refrigerant Flow (VFR) heat recovery systems Installation and Maintenance instructions." Product Installation and Maintenance manual. Carrier Corporation. 2018. downloaded from http://www.utcccs-cdn.com/hvac/docs/1001/Public/0d/38VMR-3SI.pdf. pp. 26.
"VRF—Installation / Operation Instructions." Product Manual. Lennox Industries, Inc. Jan. 2018. downloaded from https://www.vrfmobileapp.com/docs/Uploadedfiles/515201844726_507451-07_VRA _IOM.pdf.34 pages.
"VRF." Product Brochure. Lennox Industries, Inc. Mar. 2018. downlaoded from http://www.lennoxcommercial.com/pdfs/brochures/Lennox_VRF_brochure.pdf.12 pages.
"Air-conditioners indispensable optional parts: Branch Box," Installation Manual, Mitsubishi Electric. downloaded on Jun. 20, 2018 from http://trane.mylinkdrive.com/files/PAC-MKA30,50BC_Install_WG79F428H01_08-14.pdf. 40 pages.
"Air Conditioning Installation manual." Product Installation Manual. Samsung. Jan. 2017. downloaded from https://www.dvmdownload.com/upload/product/7/download/AM072FXVAFR_DVM%20S%20Installation%20Manual%20ENGLISH.pdf. 106 pages.
"Twining two ports on a MCU using standard Y-joints," Samsung HVAC Technical Bulletin 2018-0001, Samsung. Feb. 16, 2018, downloaded from https://dvmdownload.com/upload/product/170/download/DVM%20S%20Technical%20Bulletins_MCU%20port%20twinning%20with%20Y-Joint%20Kit.pdf. 1 page.
"Heat Recovery." Product Engineering Data Book. Toshiba Carrier. Dec. 2017. downloaded from http://www.utcccs-cdn.com/hvac/docs/1001/Public/01/E16-007-1.pdf. 151 Pages.
Office Action for U.S. Appl. No. 14/752,346, dated Nov. 30, 2017, Sprayberry, "Multi-Zone Variable Refrigerant Flow Heating/Cooling Unit", 14 pages.
BC Controller (with R2-Series, H2i R2-Series and Wr2-Series). Dec. 2017, Product Manual, Mitsubishi Electric Cooling & Heating. 34 pages.
Branch Circuit (BC) Controller. 2015, Product Overview, Mitsubishi Electric Cooling & Heating. 4 pages.
Variable Refrigerant Flow (VRF) System Mode Control Unit (MCU) Installation. Jan. 2015, Installation Manual, Trane. 20 pages.

* cited by examiner

MULTI-ZONE VARIABLE REFRIGERANT FLOW HEATING/COOLING UNIT

CROSS REFERENCE TO RELATED APPLICATIONS

This application is a continuation of co-pending U.S. patent application Ser. No. 14/752,346 filed Jun. 26, 2015, entitled "Multi-zone variable refrigerant flow heating/cooling unit," which claims the benefit of U.S. Provisional Application No. 62/157,109 filed May 5, 2015, entitled, "Centralized, Multi-Zone Variable Refrigerant Flow Heating/Cooling System," which are incorporated herein by reference in their entirety.

BACKGROUND

Conventional multi-zone ("MZ") air conditioning units are typically constant volume systems that maintain room air changes, space temperature, and relative humidity with a high degree of precision. A basic MZ unit can include a supply air blower segment, a coil segment and discharge air elements. Other elements, such as filters, air mixing boxes, access, and full economizer with a return/exhaust air blower, can be offered to customize a unit for a particular application. A unit discharge can be available with dampers or dual-duct openings, either in horizontal or up-blast configurations.

MZ systems often use zone dampers, located at the air unit in a particular space, to mix heated air from a heating coil and chilled air from a chilled water coil to regulate the air temperature for a space, or zone. The zone dampers, mixing air in proportions, keep the flow of mixed air to each zone approximately constant. A zone thermostat controls each pair of zone dampers. Zones are typically designed to have a separate duct that extends from the air-handling unit to the space. The MZ system is best suited for offices, schools and other similar buildings where a relatively small space requires independent zone thermostatic control.

It is with respect to these and other considerations that the disclosure made herein is presented.

SUMMARY

The following detailed description is directed to technologies for a multi-zone, variable refrigerant flow heating and/or cooling unit ("MZ VRF unit"). In some examples, the MZ VRF unit may provide heating and/or cooling to two or more zones in a structure. In some examples, a structure may include a building such as, but not limited to, a house, an office, and a warehouse. In some configurations, the MZ VRF unit may be configured to provide heated or cooled air to the one or more zones through the use of a combination of a variable refrigerant flow cooling/heating unit ("VRF unit") and a mode control unit.

In implementations, the VRF unit may be configured to deliver refrigerant flow at various rates depending on, among other possibilities, the current cooling or heating loads supplied by the MZ VRF unit. In implementations, the mode control unit may supply refrigerant from the VRF unit to two or more evaporating coils ("coils") through a thermal or thermostatic expansion valve. The coils may allow heat transfer between supply air from a supply fan and the refrigerant in the coils to reduce the temperature of the supply air for various zones in a cooling mode of operation. The reduced temperature supply air may then enter a duct for each of the various zones. A return air outlet from the zones may enter the MZ VRF unit and either be recirculated as supply air or exhausted, or various combinations of each.

In some examples, each zone supplied by the MZ VRF unit may be cooled or heated independently of each other. In implementations, the mode control unit may receive a heating and/or cooling medium from the VRF unit. The mode control unit may be configured to deliver the heating medium to the coils for one or more zones supplied by the unit and the cooling medium to the coils for one or more other zones. The heating or cooling of the one or more zones may be changed from either cooling to heating or heating to cooling depending on the needs of the particular zone.

In some examples, the presently disclosed subject matter includes an air conditioning unit. The air conditioning unit can include a housing. The housing can include a supply air inlet operable to provide supply air to a supply fan, an exhaust air outlet operable to receive air from a return/exhaust fan, a plurality of zone duct attachments operable to provide air from the air conditioning unit to a plurality of zones, and a return air attachment for receiving exhaust air from the plurality of zones.

The housing can have enclosed therein a variable refrigerant flow cooling/heating unit operable to provide a cooling or heating medium for a unit of each of the plurality of zones, the unit operable to cool or heat the supply air to its respective zone of the plurality of zones, and a mode control unit operable to switch a unit of each of the plurality of zones from a cooling mode to a heating mode.

These and various other features will be apparent from a reading of the following Detailed Description and a review of the associated drawings.

This Summary is provided to introduce a selection of technologies in a simplified form that are further described below in the Detailed Description. This Summary is not intended to identify key features or essential features of the claimed subject matter, nor is it intended that this Summary be used to limit the scope of the claimed subject matter. Furthermore, the claimed subject matter is not limited to implementations that solve any or all disadvantages noted in any part of this disclosure.

DETAILED DESCRIPTION

Figure 1:
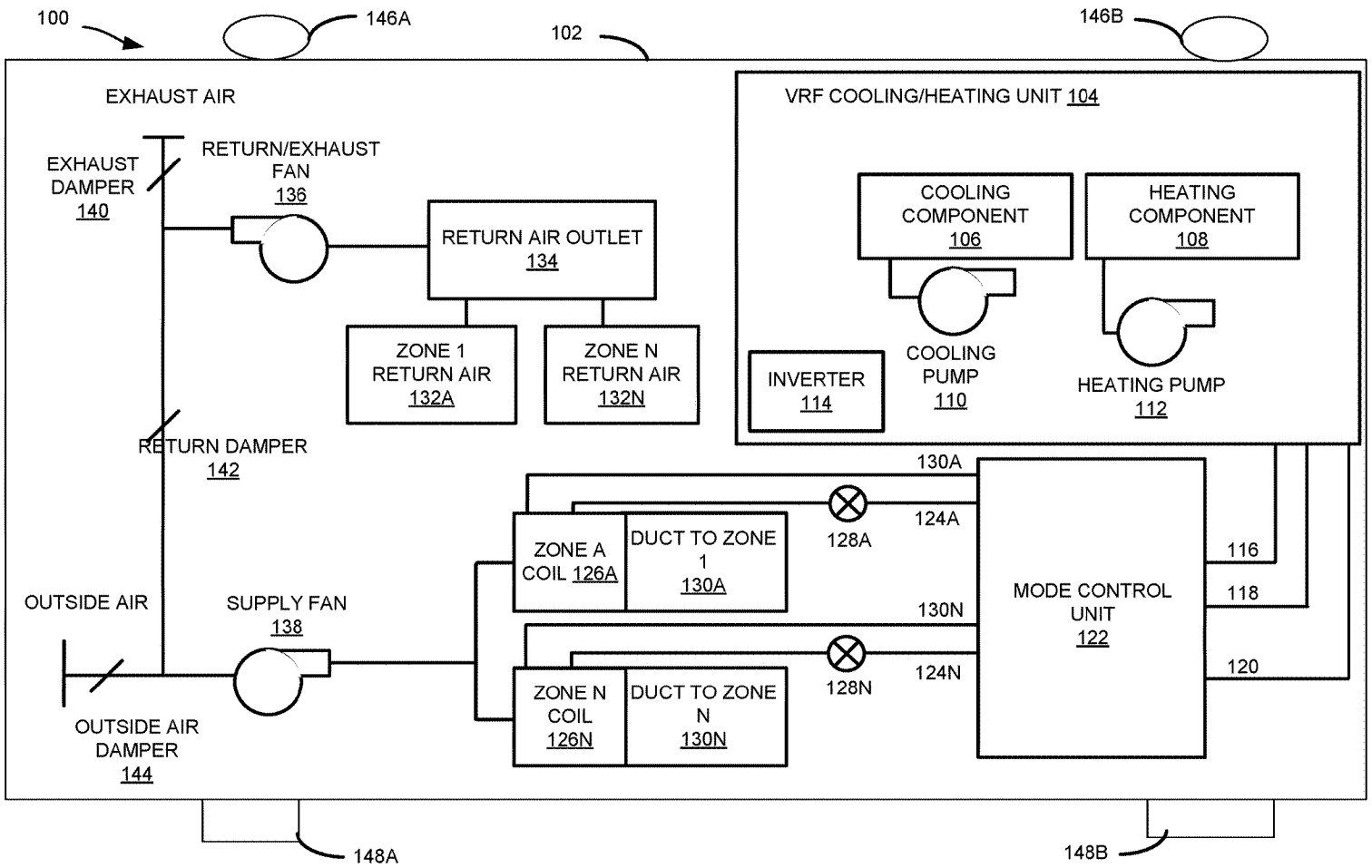
FIG. 1 is a system diagram showing an example MZ VRF unit.

Embodiments of the disclosure presented herein encompass technologies for a multi-zone, variable refrigerant flow unit, whereby a variable refrigerant flow system is incorporated with a multi-zone unit as a packaged unit or system. The MZ VRF unit may include a cooling/heating unit that provides a cooling and/or heating medium for heating and/or cooling two or more zones. A mode control unit may control the heating or cooling medium flow to one or more coils. Air provided by a supply fan is either cooled or heated and provided from the MZ VRF unit to the two or more zones. These and other aspects are described in more detail in reference to various figures.

By utilizing VRF technology in a multi-zone layout, in some implementations, one can take advantage of the ability to simultaneously provide heating and cooling to individual zones without the use of additional mediums of heat (hot water, steam, gas, or electric) and without adding heating or cooling to other zones that do not need it. In some implementations, a triple deck or three pipe multi-zone unit may be used.

Various implementations of the presently disclosed subject matter may provide various benefits. For example, in some examples, an MZ VRF unit of the presently disclosed subject matter may help to consolidate refrigerant piping and electrical wiring into the MZ VRF unit. Conventional VRF installations typically have a condensing section installed in a central location with suction and liquid lines "spidering" out to the individual room units serving the spaces. As a result, these installations may have a higher refrigerant charge need as compared to an MZ VRF unit of the presently disclosed subject matter. Some industries, such as supermarkets, have rejected air conditioning technologies that use dispersed refrigerant lines.

Combining and consolidating the VRF into a single multi-zone unit could also reduce the amount of copper, not only in refrigerant line runs, but also in the electric wiring. Instead of providing power to indoor modules all over a building, a single, large power feed could be provided to an MZ VRF unit and the power internally distributed in the unit itself. This could also cut down on building electrical costs for large and multiple VRF installations where multiple condensers and indoor modules could take up many electrical panel boards. Instead of routing piping throughout a building, refrigerant piping could be isolated from the airstream and the systems piped in a manner that would meet some refrigeration codes in some states and cities.

Another benefit of some implementations of an MZ VRF unit is that a primary amount of maintenance may be performed at the MZ VRF unit and out of the space, or zones, being serviced by the MZ VRF unit. A service provider may not have to be in a space to perform maintenance, which may disrupt occupants of the space.

An additional benefit of some implementations of an MZ VRF unit is a better ability to comply with ASHRAE standards, including Standard 15. Standard 15 generally defines an allowable amount of refrigerant that may be present in a particular space. The allowable amount of refrigerant is calculated using factors such as the size of the space and amount of refrigerant that may be dispersed into the space upon a catastrophic event such as a leak. In some examples, the MZ VRF unit contains the refrigerant within the housing and does not enter the space, thereby making it easier to comply with various standards, including the ASHRAE standards.

A still further benefit of some implementations of an MZ VRF unit may be a reduction or elimination of condensate pumps. In air conditioning systems in which refrigerant lines run through a building, depending on the environmental conditions around the lines, condensate (water) may form on the lines. If not removed, the condensate may drop onto interior surfaces of the building, possibly resulting in damage to the particular space. To prevent damage, condensate collection systems and pumps may be used to collect the condensate and pump the condensate outside of the space. In some implementations, because the refrigerant lines are contained within the housing of an MZ VRF unit, condensate formation and collection on refrigerant lines within an air conditioned space is avoided.

In the following detailed description, references are made to the accompanying drawings that form a part hereof, and in which are shown by way of illustration specific embodiments or examples. Referring now to the drawings, aspects of an exemplary operating environment and some example implementations provided herein will be described.

FIG. 1 is a system diagram showing one an example MZ VRF unit 100. The MZ VRF unit 100 may be enclosed within a housing 102. The housing 102 may fully or partially enclose various components of the MZ VRF unit 100. The housing 102 may include one or more attachment or installation components (not shown) that allow the MZ VRF unit 100 to be installed in various locations. In one configuration, the MZ VRF unit 100 may be operated in conjunction with other MZ VRF units.

The MZ VRF unit 100 may include a VRF cooling/heating unit 104. The VRF cooling/heating unit 104 may be configured to provide a heating or cooling medium to various components of the MZ VRF unit 100. In some examples, the cooling medium may include, but is not limited to, refrigerant or chilled water. In other examples, the heating medium may include, but is not limited to, fluids heated by gas heat or electric heat, hot water, steam, or heat recovered from various parts of the MZ VRF unit 100. It should be noted the presently disclosed subject matter is not limited to any particular type of cooling or heating medium.

To provide a cooling medium, the VRF cooling/heating unit 104 may include a cooling component 106. In some examples, the cooling component 106 may be a source of chilled water. In other examples, the cooling component 106 may be a refrigeration unit capable of receiving a compressible refrigerant such as R114 or R12. The presently disclosed subject matter is not limited to any particular type of configuration.

To provide a heating medium, the VRF cooling/heating unit 104 may include a heating component 108. The heating component 108 may be an apparatus or system configured to provide a heating medium. As noted above, some examples of a heating medium may include, but are not limited to, fluids heated by gas heat or electric heat, hot water, steam, or heat recovered from various parts of the MZ VRF unit 100. Therefore, the heating component 108 may be a gas or electric system configured to increase the temperature of a fluid that acts as the heating medium. In other examples, the heating component 108 may be a receptacle for receiving heated water or steam, or may be a heater configured to produce the heated water or steam. These and other implementations are merely illustrative and are not meant to limit the scope of the presently disclosed subject matter.

To circulate either the cooling medium or the heating medium from the cooling component 106 or the heating component 108, respectively, the VRF cooling/heating unit 104 may include a cooling pump 110 and a heating pump 112. The cooling pump 110 may be configured to receive the cooling medium and provide the positive pressure necessary to move the cooling medium through various components of the MZ VRF unit 100. It should be noted that in some instances, such as the case of an HVAC system utilizing a compressible refrigerant, the cooling pump 110 may be integrated into the cooling component 106 as a compressor to compress the refrigerant. It should be further noted that the presently disclosed subject matter does not require that the cooling pump 110 and the heating pump 112 to be separate components, as some implementations may use the same pump to perform both functions.

In some configurations, it may be desirable to vary the flow of the cooling medium through the MZ VRF unit 100. Having a variable flow may allow for various benefits. For example, using variable flow may allow for continuous operation at an optimal speed of the cooling pump 110 (which may be a compressor in a system using compressible refrigerant) rather than an on/off configuration. Turning the cooling pump 110 on and off, especially when done in an excessive manner, can increase the wear and tear on the equipment as well as require the use of starting current to start up the system, which may be significant depending on the particular configuration.

To provide for varying cooling flow rate, the VRF cooling/heating unit 104 may include an inverter 114. In some examples, the inverter 114 may be configured to receive an electrical input at one frequency and provide an electrical output at a plurality of second frequencies. The output of the inverter 114 is used to power the cooling pump 110. The frequency of the output of the inverter 114 controls the speed of the cooling pump 110. An increase in frequency can increase the speed (and thus flow rate) of the cooling pump 110.

Likewise, a decrease in frequency can decrease the speed (and thus flow rate) of the cooling pump 110. Thus, the MZ VRF unit 100 may be configured to receive one or more inputs that chance the output frequency of the inverter 114 to change the flow rate of the cooling medium. The inverter 114 may be also be used to control the flow rate of the heating medium through the changing of the speed of the heating pump 112.

In some configurations, the VRF cooling/heating unit 104 may be configured to provide heating, cooling, or a combination of both to various components of the MZ VRF unit 100. In one implementation, the VRF cooling/heating unit 104 may include a high-pressure vapor line 116, a low-pressure vapor line 118, and a high-pressure liquid line 120. The high-pressure vapor line 116, the low-pressure vapor line 118, and the high-pressure liquid line 120 may be controlled using a mode control unit 122.

In some configurations, the mode control unit 122 may receive the high-pressure vapor line 116, the low-pressure vapor line 118, and the high-pressure liquid line 120. The mode control unit 122 may be configured to determine the output to zone 1 supply line 124A and zone N supply line 124N. As used herein, a "zone" refers to a portion of space to which heated or cooled air is provided. A zone is not limited to any particular configuration, such as one room or one office, as a zone may also be, but is not limited to, one or more floors.

The zone 1 supply line 124A may supply a cooling medium or heating medium to a zone A coil 126A through thermal expansion valve 128A. The zone N supply line 124N may supply a cooling medium or heating medium to a zone N coil 126N through thermal expansion valve 128N. The cooling or heating medium introduced into the zone A coil 126A may exit through a return line 130A to the mode control unit 122, and eventually to the VRF cooling/heating unit 104 to provide for a closed loop. In a similar manner, the cooling or heating medium introduced into the zone N coil 126N may exit through a return line 130N to the mode control unit 122, and eventually to the VRF cooling/heating unit 104 to provide for a closed loop.

In some configurations, the VRF cooling/heating until 104 may be configured to provide heating and cooling mediums to enable heating and/or cooling of several spaces. As discussed briefly above, in some examples, the VRF cooling/heating unit 104 may include the high-pressure vapor line 116, the low-pressure vapor line 118, and the high-pressure liquid line 120. It should be noted that other implementations of a VRF cooling/heating unit using more or fewer than the high-pressure vapor line 116, the low-pressure vapor line 118, and the high-pressure liquid line 120 may provide for simultaneous heating and cooling across several spaces. The presently disclosed subject matter is not limited to any particular configuration.

In the "three pipe" VRF cooling/heating unit 104 illustrated in FIG. 1, if a zone unit, such as the zone A coil 126A or the zone N coil 126N, is to be operated in a heating mode of operation, the mode control unit 122 will configure the one or more units to act as condensers. If a zone unit, such as the zone A coil 126A or the zone N coil 126N, is to be operated in a cooling mode of operation, the mode control unit 122 will configure the one or more units to act as evaporators.

In a heating mode of operation, the mode control unit 122 will act in conjunction with the thermal expansion valve 128A or the thermal expansion valve 128N for the particular unit. For example, if the zone A coil 126A is to be used to heat a space (zone 1), the mode control unit 122 would open the zone A unit to the high-pressure vapor line 116 and the outlet of the zone A coil 126A to the high-pressure liquid line 120, causing the zone A coil 126A to act as a condenser.

In a cooling mode of operation, the mode control unit 122 will open the input of the zone A coil 126A to the high-pressure liquid line 120 and its outlet to the low-pressure vapor line 118, causing the zone A coil 126A to act as an evaporator. Similar operations may be provided for the zone N unit 126N. The heated or cooled air may be provided by a duct to zone 1 130A or a duct to zone N 130N, as appropriate. Air from the zone 1 or the zone N may be received from their respective spaces in a zone 1 return air duct 132A or a zone N return air duct 132N and be combined in return air outlet 134.

To provide air supply and recirculation, the MZ VRF unit 100 may include a return/exhaust fan 136 and a supply fan 138. The return/exhaust fan 136 may be configured to provide a negative pressure to the zone 1 return air duct 132A or the zone N return air duct 132N to pull air from their respective zones. The return air may be exhausted as exhaust air using an exhaust damper 140, a return damper 142, and an outside air damper 144. For example, if the exhaust damper 140 is open and the return damper 142 is closed, the exhausted air from the zones will be exhausted as exhaust air.

The return air may also be recirculated back into the zones as well. For example, the exhaust damper 140 may be partially or fully closed, the return damper 142 may be partially or fully open, and the outside air damper 144 may be partially or fully closed. The supply fan 138 will draw air from the exhaust of the return/exhaust fan 138 and, in some implementations, outside air through the outside air damper 144 to a particular zone.

In some implementations, all of the components of the MZ VRF unit 100 may be located within the housing 102. In some examples, the MZ VRF unit 100 may be transported and installed as a modular unit to heat/cool a building. For example, the MZ VRF unit 100 may include hoisting eyes 146A and 146B to allow a crane or other hoisting equipment to raise or lower the MZ VRF unit 100 into an appropriate position for operation. In a similar manner, the MZ VRF unit 100 may also include installation pads 148A and 148B to allow the MZ VRF unit 100 to be placed in a particular location.

In some implementations, it may be desirable to use various components to increase the efficiency of an MZ VRF unit. For example, in FIG. 1, the three pipe MZ VRF unit 100 can increase its efficiency through its dual heating/cooling capabilities, using heat absorbed in one zone to increase the temperature of in another zone. FIGS. 2-5 illustrate various technologies that may be implemented for increasing the efficiency of an MZ VRF unit.

Figure 2:
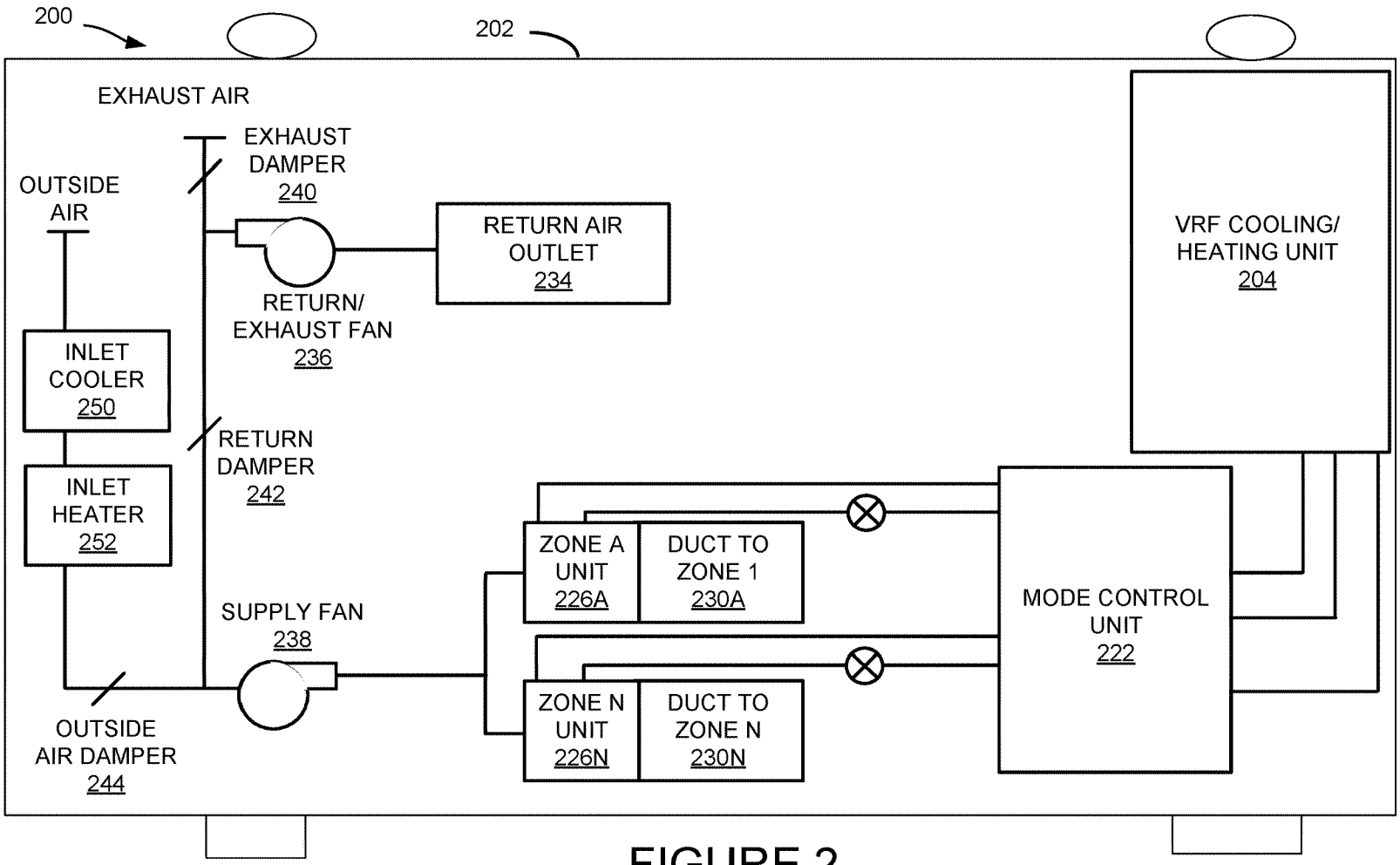
FIG. 2 is a system diagram showing an MZ VRF unit with an inlet cooler and an inlet heater.

FIG. 2 is a system diagram showing an MZ VRF unit 200 with an inlet cooler and an inlet heater. The MZ VRF unit 200 of FIG. 2 includes a housing 202. Within the housing 202 is contained a VRF cooling/heating unit 204 that may be configured to provide heating and cooling mediums to enable heating and/or cooling of several spaces. The heating or cooling mediums are provided to a mode control unit 222. The mode control unit 222 determines the particular mediums to be provided to a zone A unit 226A or a zone N unit 226N.

The zone A unit 226A or the zone N unit 226B cool or heat air provided by a supply fan 238 through a duct to zone 1 230A or a duct to zone N 230N, respectively. The supply fan 238 may receive air from a return/exhaust fan 236, which receives air from a return air outlet 234 from one or more of the zones provided by the duct to zone 1 230A or the duct to zone N 230N. Air from the one or more of the zones provided by the duct to zone 1 230A or the duct to zone N 230N may be exhausted through the exhaust air damper 240 or provided, in whole or in part, to the supply fan via return damper 242.

In some examples, it may be beneficial or necessary to receive air from a source in addition to the air received from the return/exhaust fan 236. In those examples, the supply fan may also receive outside air through an outside air damper 244. In some examples, the outside air may be at a temperature that will cause the efficiency of the MZ VRF unit 100 to decrease. Thus, in some examples, the outside air may be preconditioned prior to receipt by the supply fan 238.

In FIG. 2, the outside air is preconditioned using an inlet cooler 250 and/or an inlet heater 252. The inlet cooler 250 may be configured to reduce the temperature of the outside air prior to receipt by the supply fan. The inlet heater 252 may be configured to increase the temperature of the outside air prior to receipt by the supply fan. In some examples, the inlet cooler 250 may be a compressible refrigeration system or a water-based system that received chilled water from various sources. In some examples, the inlet heater 252 may receive heated water or steam from various sources, or may be a gas or electric heater.

In some examples, the inlet cooler 250 and/or the inlet heater 252 may be part of a heat recovery system. For example, return air from a heated zone may be used as a heat source for the inlet heater 252. In a similar manner, return air from a cooled zone may be used as a refrigeration source for the inlet cooler 250. In other examples, the inlet cooler 250 or the inlet heater 252 may be used to increase or decrease the temperature of a heating or cooling medium.

Figure 3:
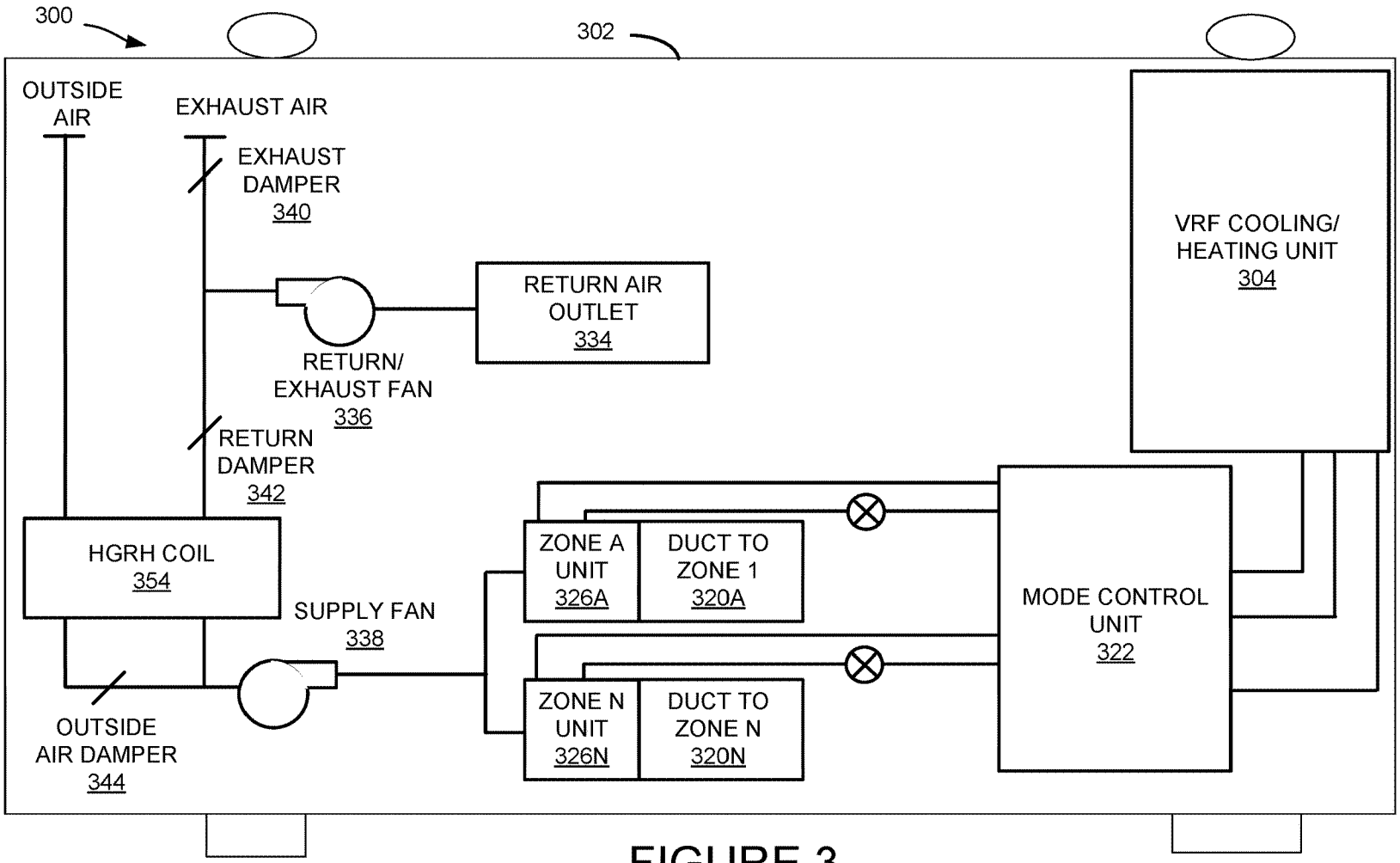
FIG. 3 is a system diagram showing an MZ VRF unit with a hot gas reheater.

FIG. 3 is a system diagram showing an MZ VRF unit 300 with a hot gas reheater. The MZ VRF unit 300 of FIG. 3 includes a housing 302. Within the housing 302 is contained a VRF cooling/heating until 304 that may be configured to provide heating and cooling mediums to enable heating and/or cooling of several spaces. The heating or cooling mediums are provided to a mode control unit 322. The mode control unit 322 determines the particular mediums to be provided to a zone A unit 326A or a zone N unit 326N.

The zone A unit 326A or the zone N unit 326B cool or heat air provided by a supply fan 338 through a duct to zone 1 330A or a duct to zone N 330N, respectively. The supply fan 338 may receive air from a return/exhaust fan 336, which receives air from a return air outlet 334 from one or more of the zones provided by the duct to zone 1 330A or the duct to zone N 330N. Air from the one or more of the zones provided by the duct to zone 1 330A or the duct to zone N 330N may be exhausted through the exhaust air damper 340 or provided, in whole or in part, to the supply fan via return damper 342.

In FIG. 3, a hot gas reheat ("HGRH") coil 354 is provided. The HGRH coil 354 may provide various benefits. In some examples, the HGRH coil 354 may reduce the humidity of incoming outside air or the exhaust air from the return/exhaust fan 336. In other examples, the HGRH coil 354 may decrease the temperature of the incoming outside air or the exhaust air from the return/exhaust fan 336.

In some examples, the HGRH coil 354 may receive as an input a relatively hot high-pressure vapor refrigerant. Refrigerant is passed through the HGRH coil 354, which is a heat exchanged located downstream of a cooling coil. The hot high pressure vapor leaving the compressor passes through the HGRH coil 354 prior to entering a condenser coil.

Figure 4:
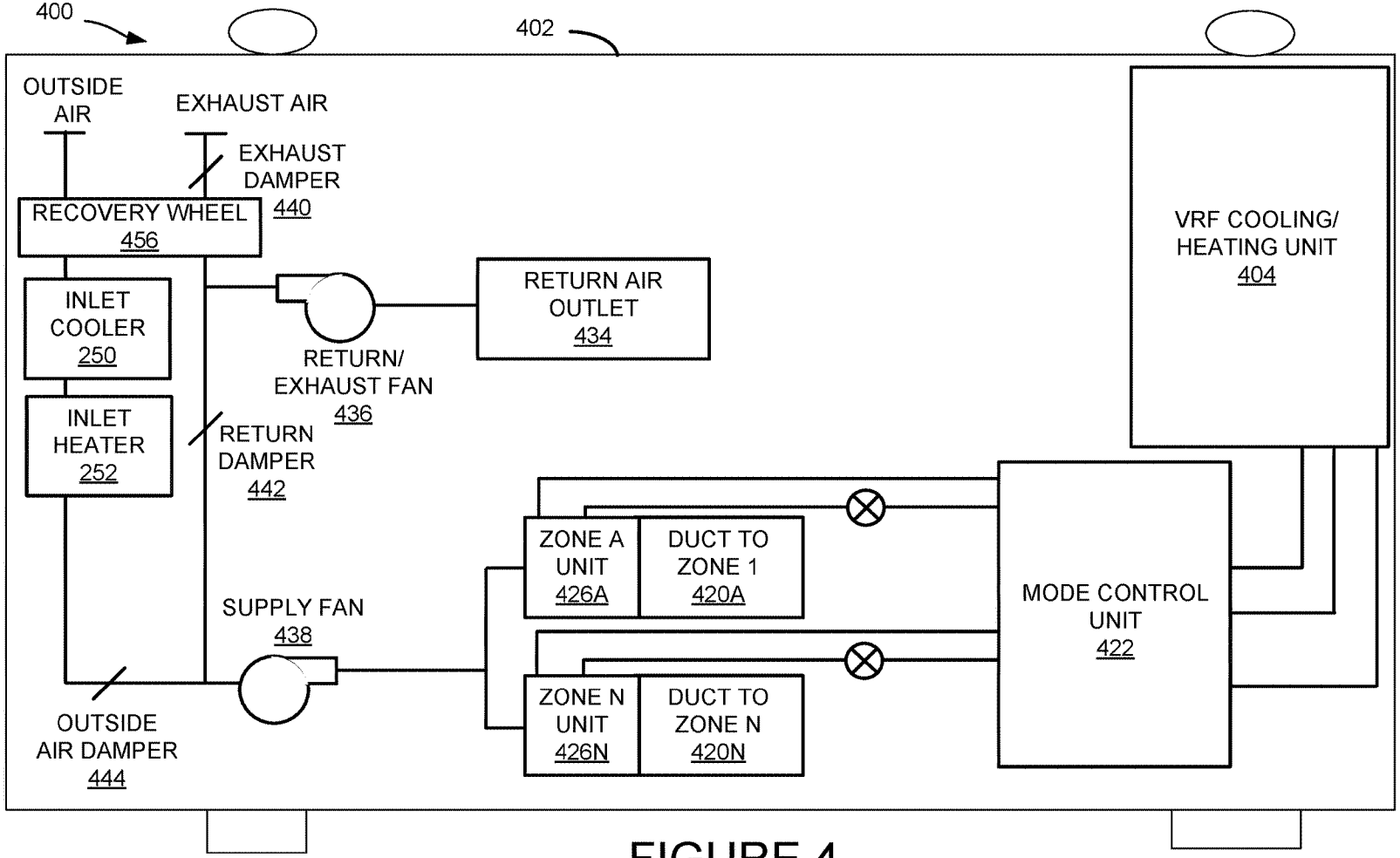
FIG. 4 is a system diagram showing an MZ VRF unit with a recovery wheel.

FIG. 4 is a system diagram showing an MZ VRF unit 400 with a recovery wheel. The MZ VRF unit 400 of FIG. 4 includes a housing 402. Within the housing 402 is contained a VRF cooling/heating until 404 that may be configured to provide heating and cooling mediums to enable heating and/or cooling of several spaces. The heating or cooling mediums are provided to a mode control unit 422. The mode control unit 422 determines the particular mediums to be provided to a zone A unit 426A or a zone N unit 426N.

The zone A unit 426A or the zone N unit 426B cool or heat air provided by a supply fan 438 through a duct to zone 1 430A or a duct to zone N 430N, respectively. The supply fan 438 may receive air from a return/exhaust fan 436, which receives air from a return air outlet 434 from one or more of the zones provided by the duct to zone 1 430A or the duct to zone N 430N. Air from the one or more of the zones provided by the duct to zone 1 430A or the duct to zone N 430N may be exhausted through the exhaust air damper 440 or provided, in whole or in part, to the supply fan via return damper 442.

In FIG. 4, a recovery wheel/plate 456 may be used to reclaim energy. In some examples, the recovery wheel/plate 456 may be an enthalpy-type device comprised of a rotating cylinder filled with an air permeable material, which results in a large surface area. As the wheel rotates between the outgoing exhaust air stream and the incoming air stream, energy in the form of heat is received from the higher temperature air stream and released into the colder air stream. Examples materials for wheel construction include, but are not limited to, plastics, polymers, metals (such as aluminum), and various fibers. Desiccants may be used for various reasons, including humidity control and enthalpy exchange. Example desiccant materials may include, but are not limited to, silica gel and molecular sieves.

In some examples, the recovery wheel/plate 456 may be a plate-type of heat exchanger. In these examples, the recovery wheel/plate 456 may include alternating layers of plates that are separated and sealed. Heat is exchanged between a higher temperature air flow and a lower temperature air flow, such as the supply air and the exhaust air. Desiccants may be used for various reasons, including, but not limited to, humidity control. Example desiccant materials may include, but are not limited to, silica gel and molecular sieves.

Figure 5:
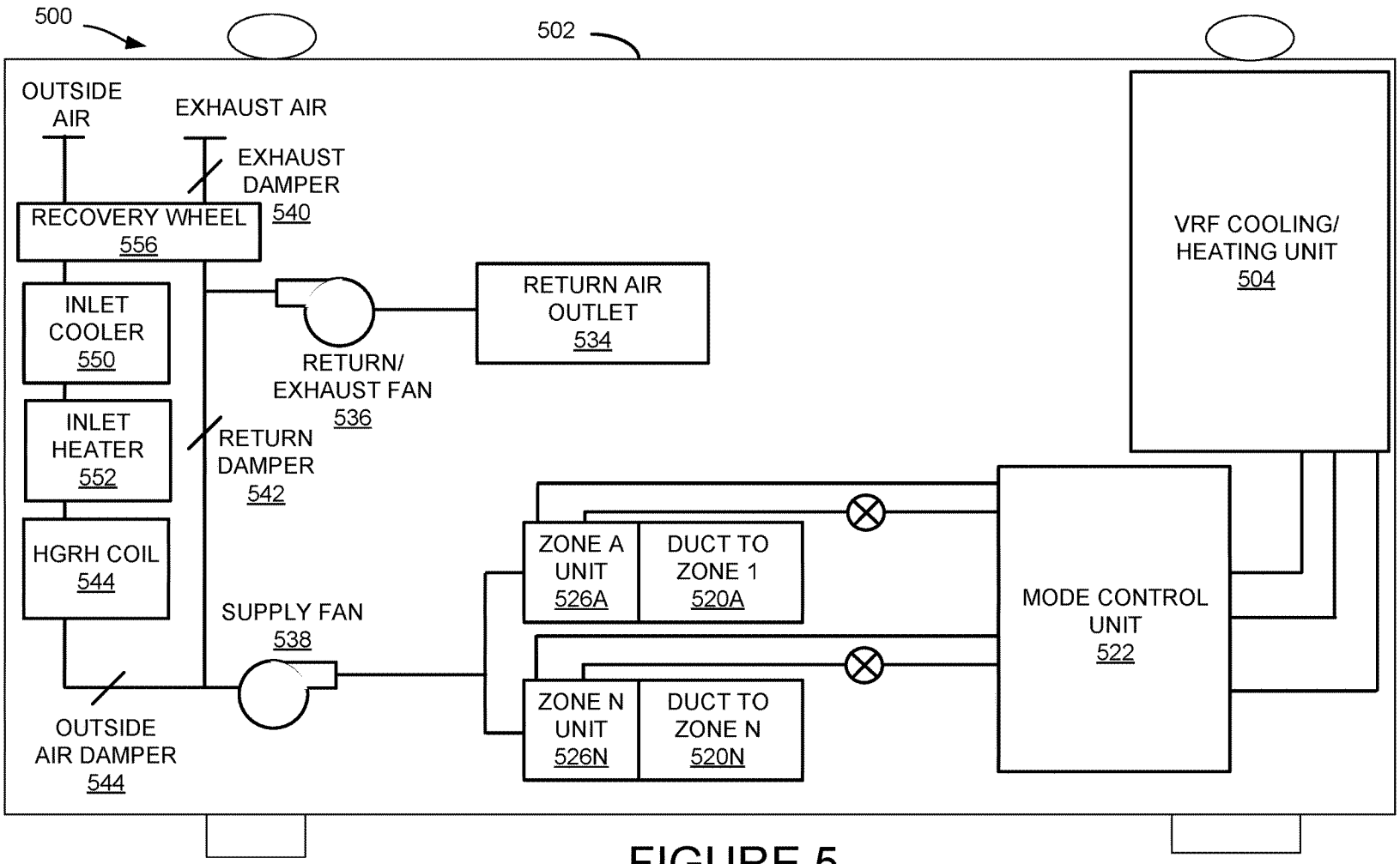
FIG. 5 is a system diagram showing an MZ VRF unit with various recapture and regeneration technologies.

FIG. 5 is a system diagram showing an MZ VRF unit 500 with various recapture and regeneration technologies. The MZ VRF unit 500 of FIG. 5 includes a housing 502. Within the housing 502 is contained a VRF cooling/heating until 504 that may be configured to provide heating and cooling mediums to enable heating and/or cooling of several spaces. The heating or cooling mediums are provided to a mode control unit 522. The mode control unit 522 determines the particular mediums to be provided to a zone A unit 526A or a zone N unit 526N.

The zone A unit 526A or the zone N unit 526B cool or heat air provided by a supply fan 538 through a duct to zone 1 530A or a duct to zone N 530N, respectively. The supply fan 538 may receive air from a return/exhaust fan 536, which receives air from a return air outlet 534 from one or more of the zones provided by the duct to zone 1 530A or the duct to zone N 530N. Air from the one or more of the zones provided by the duct to zone 1 530A or the duct to zone N 530N may be exhausted through the exhaust air damper 540 or provided, in whole or in part, to the supply fan via return damper 542.

The MZ VRF unit 500 includes various recapture and regeneration technologies. For example, the MZ VRF unit 500 includes an inlet cooler 550 and an outlet cooler 552 for conditioning air entering the MZ VRF unit 500. The MZ VRF unit 500 also includes an HGRH coil 544 that may be used to control humidity of the incoming air. In addition, the MZ VRF unit 500 includes a recovery wheel 556 that may be used to recover heat or cold exhausted from the return/exhaust fan 536.

Figure 6:
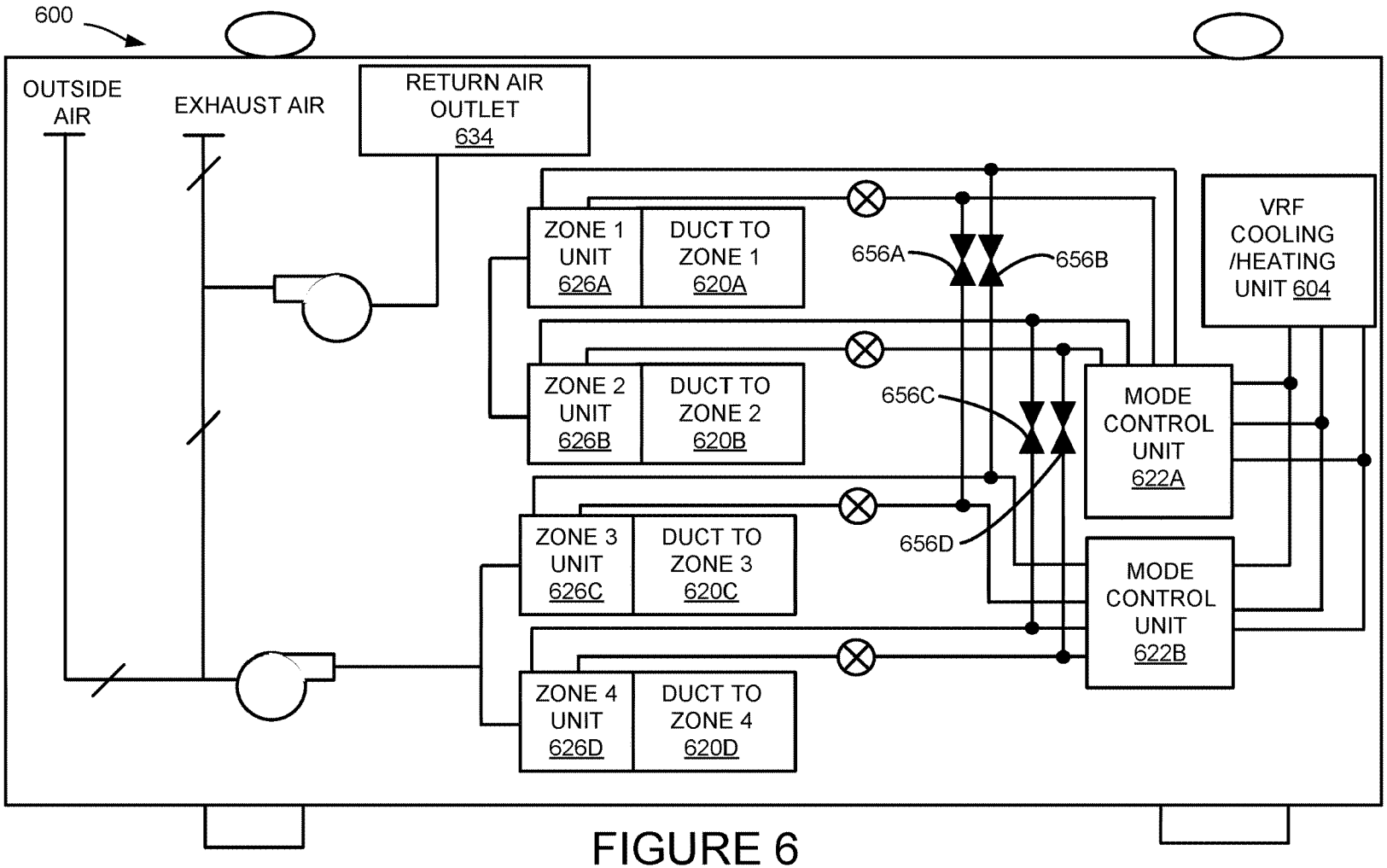
FIG. 6 is a system diagram showing an MZ VRF unit with more than one mode control unit.

FIG. 6 is a system diagram showing an MZ VRF unit 600 with more than one mode control unit. In the MZ VRF unit 600 of FIG. 6, zones have been coupled to more than one mode control unit. The VRF cooling/heating unit 604 provides a heating or cooling medium to mode control unit 622A and/or mode control unit 622B. The mode control unit 622A is coupled to zone 1 unit 626A and zone 2 unit 626B. The mode control unit 622B is coupled to zone 3 unit 626C and zone 4 unit 626D. The zone 1 unit 626A heats or cools the air entering a duct to zone 1 620A. The zone 2 unit 626B heats or cools the air entering a duct to zone 2 620B. The zone 3 unit 626C heats or cools the air entering a duct to zone 3 620C. The zone 4 unit 626D heats or cools the air entering a duct to zone 4 620D. The exhaust from the zones may be received into the return air outlet 634 for recirculation or exhaust from the MZ VRF unit 600.

In the configuration illustrated in FIG. 6, the mode control unit 622A may be separately operable from the mode control unit 622B. Thus, a greater degree of control may be provided to various zones. In some configurations, the mode control unit 622A may be configured to deliver a cooling or heating medium to the zone 3 unit 626C and/or the zone 4 unit 626D to provide for redundancy should the mode control unit 622B discontinue operation.

The mode control unit 622A and/or the mode control 622B may be configured to operate valves 656A-656D to allow for cooling and/or heating in a redundant mode of operation. For example, if the mode control unit 622A becomes inoperable, the mode control unit 622B may open valves 656A-656D to provide a cooling or heating medium to the zone 1 unit 626A and/or the zone 2 unit 626B. In a similar manner, if the mode control unit 622B becomes inoperable, the mode control unit 622A may open valves 656A-656D to provide a cooling or heating medium to the zone 3 unit 626C and/or the zone 4 unit 626D.

Figure 7:
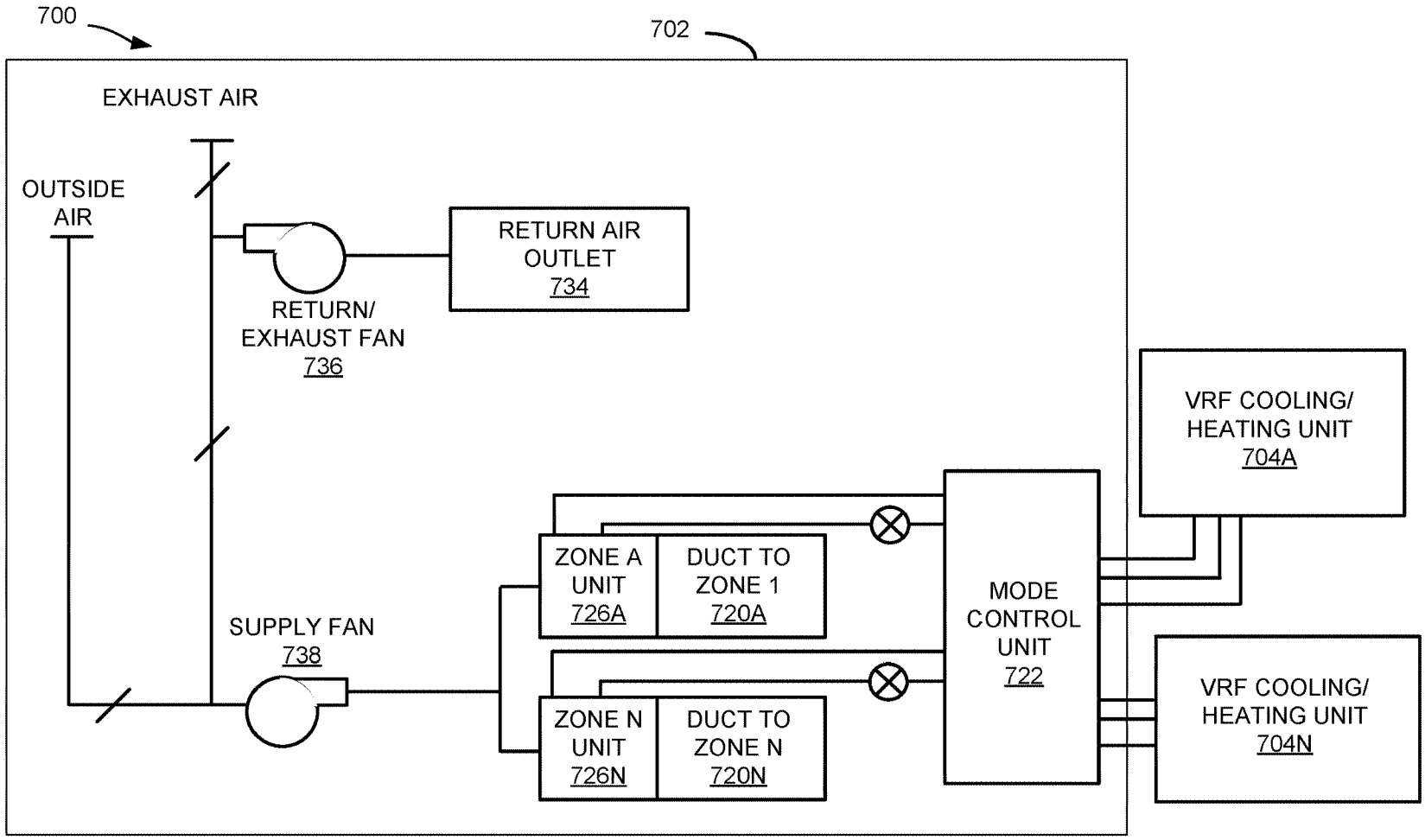
FIG. 7 is a system diagram showing an MZ VRF unit with more than one VRF cooling/heating unit.

FIG. 7 is a system diagram showing an MZ VRF unit 700 with more than one VRF cooling/heating unit. In FIG. 7, to provide a heating and/or cooling medium to a mode control unit 722, the MZ VRF 700 includes a VRF cooling/heating unit 704A and a VRF cooling/heating unit 704N. Having two or more VRF cooling/heating units, such as the VRF cooling/heating unit 704A and the VRF cooling/heating unit 704N, redundancy may be provided.

In one example, the VRF cooling/heating unit 704A may be a primary or active unit that provides a heating and/or cooling medium to the mode control unit 722, which in turn provides the appropriate medium to a zone A unit 726A or a zone N unit 726N. The zone A unit 726A and the zone N unit 726N cool air supplied to a duct to zone 1 720A or a duct to zone N 720N, respectively. If the VRF cooling/heating unit 704A ceases operation or is otherwise unavailable, the VRF cooling/heating unit 704N may be used to maintain heating or cooling.

In FIG. 7, the VRF cooling/heating unit 704A and the VRF cooling/heating unit 704N are shown to be outside of a housing 702. The presently disclosed subject matter is not limited to any particular component to be required within a housing, such as the housing 702. In some implementations, major components of an MZ VRF unit, other than ductwork going to various zones and electrical components, are contained within the housing. In other implementations, some components may be located outside of the housing. For example, in some implementations, the return/exhaust fan 736 and/or the supply fan 738 may be external to the housing 702. These and other implementations are considered to be within the scope of the presently disclosed subject matter.

Figure 8:
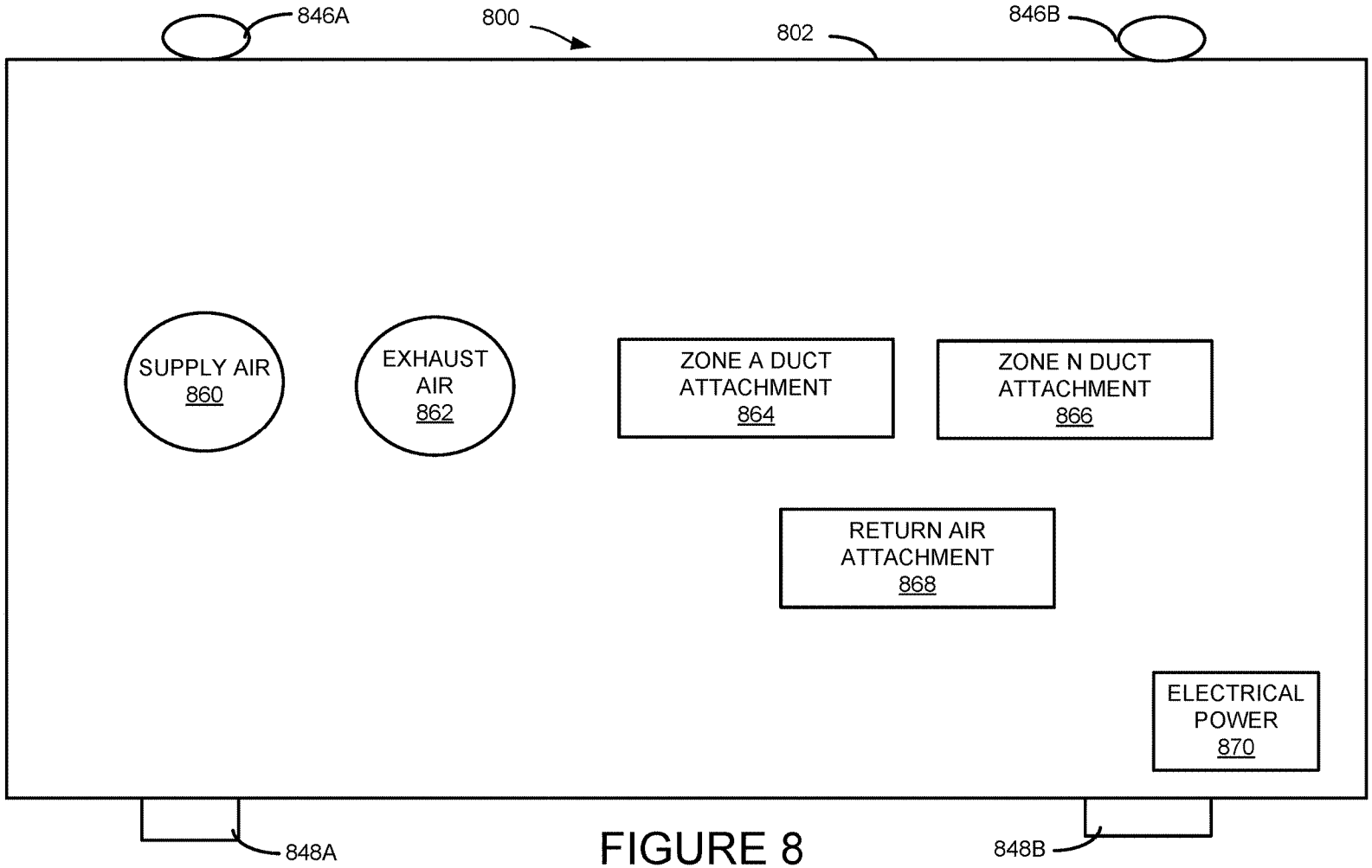
FIG. 8 is a diagram showing example connections to a housing of an MZ VRF unit.

FIG. 8 is a diagram showing example connections to a housing 802 of an MZ VRF unit 800. In FIG. 8, the housing 802 may be configured to receive and exhaust air as well as provide electrical power to various components within the housing 802. The housing 802 may be configured to enclose various components of the MZ VRF unit 800, such as, but not limited to, the VRF cooling/heating unit 104 and the mode control unit 122 of FIG. 1. In another implementation, the housing 802 may further enclose various fans such as, but not limited to, the return/exhaust fan 136 and the supply fan 138.

To provide air to the supply fan 138, the housing 802 may include one or more supply air inlets 860, to which ducting may connect to the supply fan 138. In a similar manner, to provide an outlet from the return/exhaust fan 136, the housing 802 may include one or more exhaust air outlets 862, to which ducting may connect to the return/exhaust fan 136. To supply various zones, the housing 802 may include connections to individual zones, such as a zone A duct attachment 864 and a zone N duct attachment 866.

The zone A duct attachment 864 and the zone N duct attachment 866 may receive cooled or heated air and connect to ductwork going to the various zones supplied by the MZ VRF unit 800. The return air attachment 868 may provide an attachment means for receiving air coming from the zones to the return/exhaust fan 138. An electrical power supply 870 may provide one or more electrical connections that supply power to various components of the MZ VRF unit 800.

The MZ VRF unit 800 may include hoisting eyes 846A and 846B to allow a crane or other hoisting equipment to raise or lower the MZ VRF unit 800 into an appropriate position for operation. In a similar manner, the MZ VRF unit 800 may also include installation pads 848A and 848B to allow the MZ VRF unit 800 to be placed in a particular location.

Figure 9:
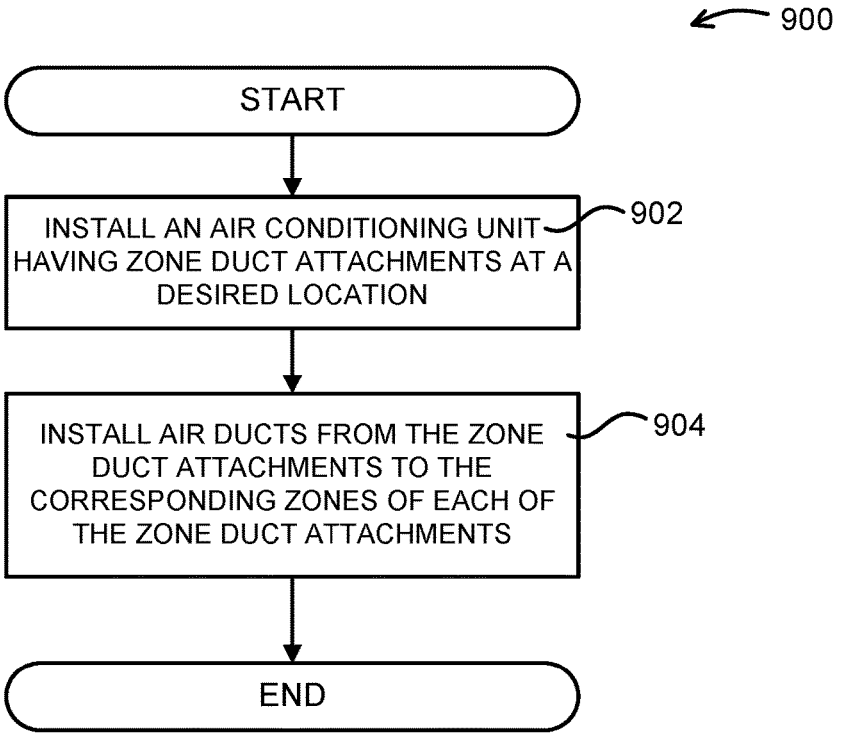
FIG. 9 illustrates one configuration of a routine for using an MZ VRF unit.

FIG. 9 illustrates one configuration of a routine 900 for using an MZ VRF unit. Unless otherwise indicated, more or fewer operations may be performed than shown in the figures and described herein. Additionally, unless otherwise indicated, these operations may also be performed in a different order than those described herein.

Routine 900 commences at operation 902, where an air conditioning unit is installed at a desired location. In some examples, the air conditioning unit can include a housing. In some examples, the housing can include a supply air inlet operable to provide supply air to a supply fan, an exhaust air outlet operable to receive air from a return/exhaust fan, a plurality of zone duct attachments operable to provide air from the air conditioning unit to a plurality of zones, and a return air attachment for receiving exhaust air from the plurality of zones. In some implementations, the housing can have enclosed therein a variable refrigerant flow cooling/heating unit operable to provide a cooling or heating medium for a unit of each of the plurality of zones, the unit operable to cool or heat the supply air to its respective zone of the plurality of zones, a plurality of ducts, wherein each of the plurality of ducts is operable to receive heated or cooled supply air from the unit of each of the plurality of zones and supply the heated or cooled supply air to a zone, a mode control unit operable to switch a unit of each of the plurality of zones from a cooling mode to a heating mode, the supply fan operable to provide supply air to the unit of each of the plurality of zones, and the exhaust fan operable to receive exhaust air from each of the plurality of zones.

The routine 900 continues from operation 902 to operation 904, where a plurality of air ducts are installed from the plurality of zone duct attachments to the plurality of zones. The routine 900 ends thereafter.

The subject matter described above is provided by way of illustration only and should not be construed as limiting. Various modifications and changes may be made to the subject matter described herein without following the example embodiments and applications illustrated and described, and without departing from the true spirit and scope of the present invention, which is set forth in the following claims.

What is claimed is:

1. An air conditioning unit, comprising:

a housing that encloses:

a first zone duct attachment to provide the supply air from the supply air inlet to a first coil used to heat or cool air entering a first zone, wherein the first zone comprises a first portion of space to which heated or cooled air is provided, a second zone duct attachment to provide supply air from the air conditioning unit supply air inlet to a second coil used to heat or cool air entering a second zone, wherein the second zone comprises a second portion of space to which heated or cooled air is provided, the first coil to heat the supply air to a first zone when the first coil is in a heating mode of operation and to cool the supply air to the first zone when the first coils is in a cooling mode of operation, the second coil to heat the supply air to the second zone when the second coils is in a heating mode of operation and to cool the supply air to the second zone when the second coil is in a cooling mode of operation, a variable speed cooling pump to supply the cooling medium to the first coil when the first coil is in a cooling mode of operation, and, supply the cooling medium to the second coil when the second coil is in a cooling mode of operation, a variable speed heating pump to supply the heating medium to the first coil when the first coil is in a heating mode of operation, and, supply the heating medium to the second coil when the second coil is in a heating mode of operation, and a mode control unit operable to switch the first coil or the second coil from the cooling mode of operation to the heating mode of operation by switching a fluid moving through the first coil or the second coil from the cooling medium to the heating medium, and the mode control unit is further operable to switch the first coil or the second coil from the heating mode of operation to the cooling mode of operation by switching the fluid moving though the first coil or the second coil from the heating medium to the cooling medium.

2. The air conditioning unit of claim 1, further comprising a supply fan to provide the supply air, and an exhaust fan operable to receive exhaust air from the first zone or the second zone.

3. The air conditioning unit of claim 1, further comprising an inlet cooler for cooling supply air prior to receipt by the supply fan.

4. The air conditioning unit of claim 1, further comprising an inlet heater for heating supply air prior to receipt by the supply fan.

5. The air conditioning unit of claim 1, wherein the housing further comprises a plurality of hoisting eyes to allow hoisting equipment to raise or lower the housing into an appropriate position.

6. The air conditioning unit of claim 1, wherein the housing further comprises a plurality of installation pads to allow the housing to be placed in a particular location.

* * * * *